United States Patent [19]

McKenzie

[11] 4,030,513

[45] June 21, 1977

[54] TANK WASHER

[75] Inventor: Wray V. McKenzie, Downers Grove, Ill.

[73] Assignee: Babson Bros. Co., Oak Brook, Ill.

[22] Filed: Nov. 5, 1975

[21] Appl. No.: 628,890

[52] U.S. Cl. ..... 134/167 R; 134/179; 239/DIG. 1; 239/251

[51] Int. Cl.[2] ..... B08B 3/02; B08B 9/00

[58] Field of Search ..... 134/167 R, 168 R, 172, 134/179; 239/DIG. 1, 120, 251, 264, 261, 554, 600

[56] References Cited

UNITED STATES PATENTS

| | | | |
|---|---|---|---|
| 1,996,159 | 4/1935 | Kittredge | 239/554 X |
| 2,494,067 | 1/1950 | Snowden et al. | 239/554 |
| 2,954,038 | 9/1960 | Girard | 134/167 R |
| 3,029,030 | 4/1962 | Dey, Sr. | 239/DIG. 1 |
| 3,038,668 | 6/1962 | Handberg | 239/600 X |
| 3,104,672 | 9/1963 | Holdren | 134/168 R |

*Primary Examiner*—Robert L. Bleutge

*Attorney, Agent, or Firm*—Wegner, Stellman, McCord, Wiles & Wood

[57] ABSTRACT

A tank washer such as for use in washing bulk milk tanks, including a liquid-driven spray head rotatably carried on a supply tube extending downwardly into the tank. The spray head is caused to rotate at a relatively low speed, permitting generally square jet streams of the washing liquid to develop a spray pattern effectively completely wetting the interior of the tank to provide effectively optimum washing action. The spray head includes a drain port for draining the apparatus upon termination of the washing liquid delivery. The spray head may be formed of a plurality of similar annular elements and securing structure for securing the elements in a tubular assembly adapted to be rotated coaxially about the delivery tube by reaction force generated by the jet streams. The annular elements cooperatively define the jet ports and include deflector shoulders for directing a portion of the jet streams angularly upwardly.

10 Claims, 8 Drawing Figures

FIG. 1
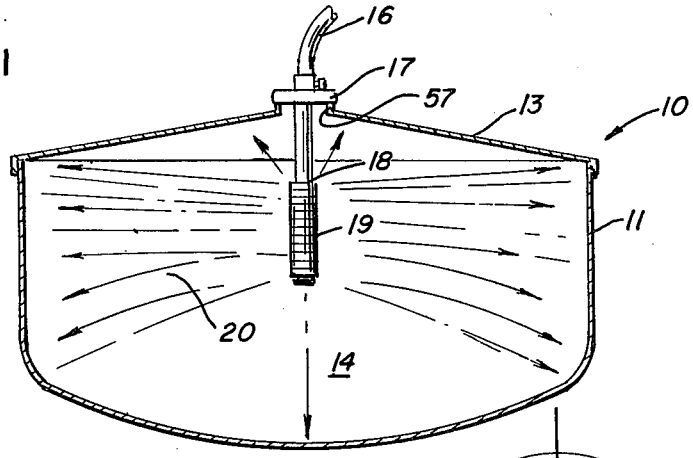
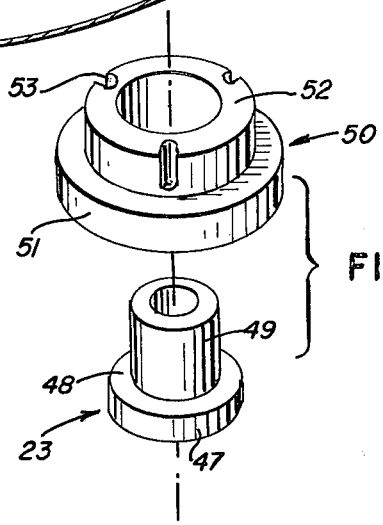
FIG. 5c
FIG. 2
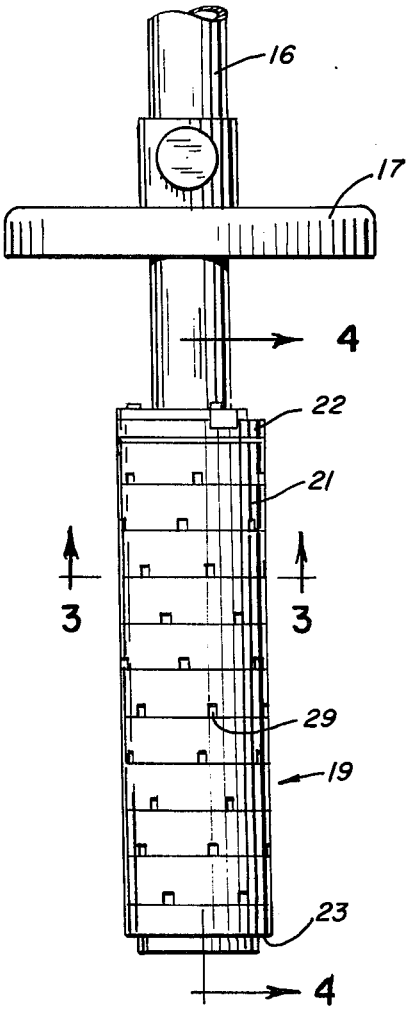
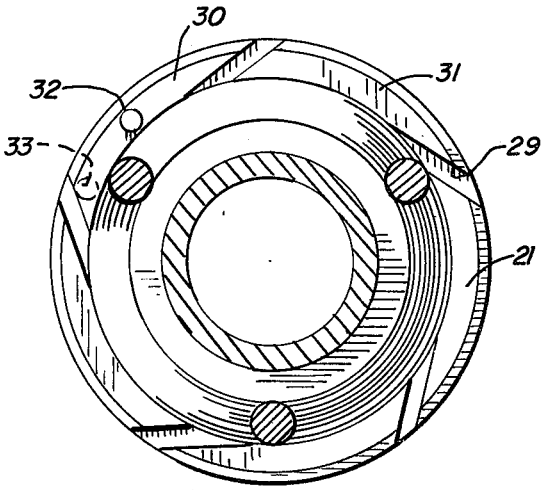
FIG. 3

TANK WASHER

BACKGROUND OF THE INVENTION

1. Field of the Invention

This invention relates to tank washing apparatus and in particular to such apparatus adapted for use in washing bulk milk tanks and the like.

2.Description of the Prior Art

In one improved form of bulk milk tank washer marketed by the assignee hereof, a demountable spray ball is provided on the end of a delivery conduit within the tank. The spray ball is provided with a plurality of ports directing the washing liquid in a preselected distribution against the interior wall surfaces of the milk tank.

In such bulk milk tank washers, the washing liquid is provided under pressure from a suitable pump connected to the tank for circulation of the washing liquid in the tank washing operation. Conventionally, the liquid may be provided at pressures of up to 20 to 25 p.s.i.g.

SUMMARY OF THE INVENTION

The present invention comprehends an improved tank washer apparatus having a rotating spray head adapted to be driven by the force of the washing liquid delivered from the spray head in the form of jet streams against the inner wall surfaces of the tank to be washed.

The use of the rotating spray head provides an improved preselected tank washing spray pattern providing improved efficiency in the tank washing operation and thereby permitting reduction in energy requirements to effect the necessary sanitizing of the tank such as where the tank comprises as bulk milk tank.

The invention comprehends such a tank washer apparatus including a tubular spray head rotatably carried on a delivery portion of a liquid supply tube disposed within the tank to be washed. Washing liquid may be delivered through the delivery portion into the spray head at a pressure of upwards to 20 to 25 p.s.i.g., with the spray head rotating approximately 650 R.P.M. at a normal pressure of 22 p.s.i.g. in the illustrated embodiment.

The spray head may be formed of a plurality of annular elements retained in stacked association by a suitable securing means extending between opposite end portions of the assembly. In the illustrated embodiment, the securing means includes tie bolts extending between a bottom element and a top element of the assembly.

The top element may be provided with suitable ports for directing a portion of the washing liquid upwardly against the underside of the tank cover.

The bottom element may be provided with a drain port for draining the apparatus upon termination of the delivery of washing liquid thereto. The bottom element port may further provide a stream of washing liquid downwardly against the lower portion of the inner tank wall surface during the washing operation.

The stacked annular spray head elements may cooperatively define squared ports providing the desired spray distribution pattern. A shoulder means on the lowermost of each pair of the stacked elements may define a deflector for deflecting a portion of the jet stream angularly upwardly as the washing liquid leaves the port to provide an improved washing action.

The deflector shoulder may be defined by an annular peripheral flange upstanding from the upper portion of the annular spray head element and adapted to mate with a radially inner, downwardly extending flange on the superjacent element of the stack. Thus, the deflector flange further serves as means for coaxially aligning the respective elements of the stack.

Each of the elements may be similar and, thus, the spray head may be formed at low cost by utilization of a preselected plurality of such similar elements in the desired stacked configuration. By suitably selecting the tie bolt length herein, spray heads of different desired lengths may be readily obtained to correspond with the height dimension of the tank to be washed.

The spray head may be journaled on suitable bearing elements defining portions of the bottom and top elements of the apparatus.

The spray head elements may be formed of molded synthetic resin of low cost and facilitated maintenance and servicing.

Thus, the tank washer of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a vertical section of a tank having a washer apparatus embodying the invention;

FIG. 2 is a fragmentary enlarged elevation of the washer apparatus;

FIG. 3 is an enlarged horizontal section taken substantially along the line 3—3 of FIG. 2;

DESCRIPTION OF THE PREFERRED EMBODIMENT

Figure 4:
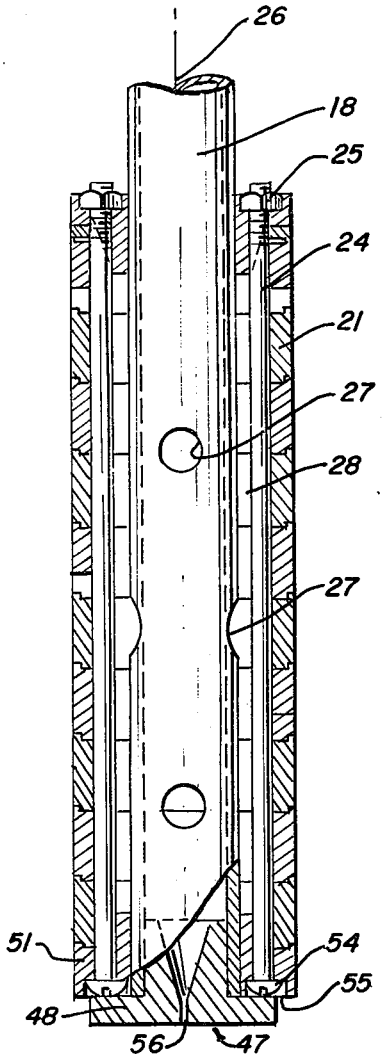
FIG. 4 is a fragmentary enlarged vertical section taken substantially along the line 4—4 of FIG. 2.

In the exemplary embodiment of the invention as disclosed in the drawing, a tank generally designated 10 is shown to comprise a conventional bulk milk tank having sidewalls 11, a bottom wall 12, and a removable top wall 13. The present invention is concerned with providing suitable washing liquid in the tank space 14 for cleaning the interior surfaces of the tank walls, when desired.

More specifically, the invention comprehends providing an improved tank washer apparatus generally designated 15 for effecting such washing of the tank walls. As shown in FIG. 1, the washer apparatus includes a liquid supply tube 16 extending downwardly through a sealing connector 17 in the top wall 13 to dispose a lower delivery portion 18 generally centrally of the tank space 14. The washer apparatus further includes a spray head 19 rotatably carried on the supply tube delivery portion 18 for delivering the washing liquid in a plurality of jet streams generally designated 20 in a revolving distribution against the interior wall surfaces. The improved spray pattern provided by the spray head provides an improved tank washing operation with reduced energy requirements as a result of the improved efficiency of the tank cleaning operation.

More specifically, as shown in FIG. 2, spray head 19 is defined by a plurality of mid-portion annular elements 21 retained in a stacked tubular configuration between an upper end assembly 22 and a lower end assembly 23, the tubular configuration being secured by a plurality of tie bolts 24 and nuts 25. In the illustrated embodiment, three such tie bolt means are provided spaced at 120° angles about the axis 26 of the delivery portion 18 of the supply tube. The delivery portion is provided with a plurality of radial openings 27 for delivering the washing liquid outwardly into the tubular space 28 extending about delivery tube 18 within the tubular array of elements 21.

Figure 6:
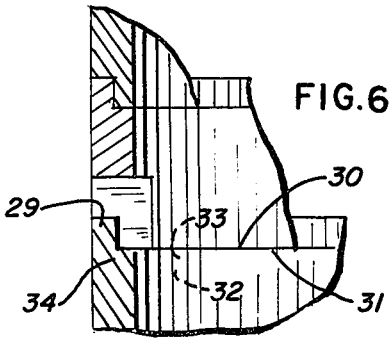
FIG. 6 is a fragmentary enlarged vertical section illustrating the delivery of the jet stream from the spray head through one port thereof.

As best seen in FIGS. 2 and 6, the elements 21 cooperatively define a plurality of spray ports 29 for delivering the washing liquid outwardly in jet streams to impinge against the inner wall surfaces of the tank in a distributed pattern defined by the distribution of ports in the spray head. The ports may have a rectangular cross section, as seen in FIG. 2, and, thus, the washing liquid streams have a similar rectangular cross section upon leaving the ports.

Figure 5:
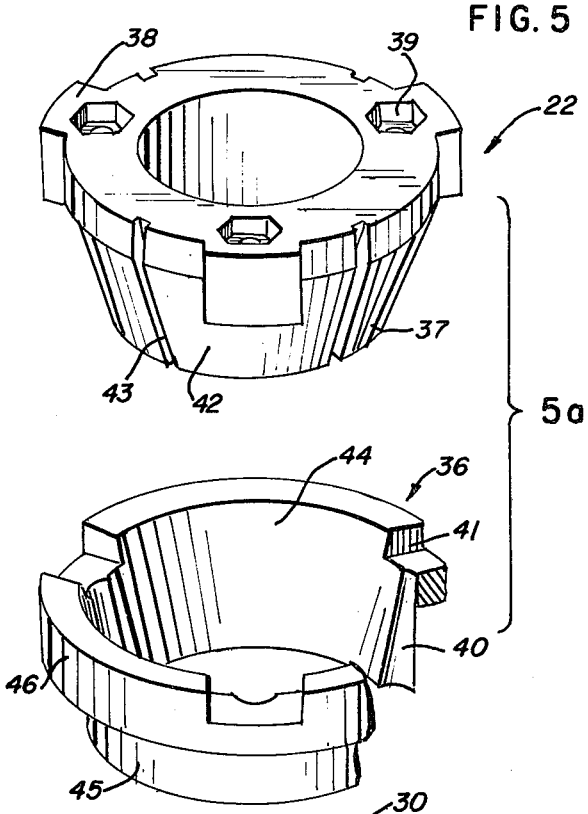
FIG. 5 is an exploded view of the annular elements of the spray head including, in FIG. 5*a*, the upper end elements thereof, in FIG. 5*b*, a pair of the mid-portion elements thereof, and in FIG. 5*c*, the bottom elements thereof.

Referring now to FIGS. 3, 5 and 6, each of the elements 21 defines an upper surface portion 30 and a lower surface portion 31. A pin 32 may be provided on the lower surface portion 31 for reception in an opening 33 in the upper surface portion 30 of the subjacent element 21, thereby locking the elements 21 against rotation with respect to each other in the assembled arrangement. The upper surface portion 30 defines a peripheral upstanding annular flange 34 forming a deflector tending to deflect a portion of the washing liquid passing outwardly through port 29 angularly upwardly. The lower surface portion 31 of each element 21 defines a radially inner depending annular flange 35 adapted to nest within annular flange 34 of the subjacent element 21, thereby retaining the respective elements in coaxial aligned association.

Figure 5B:
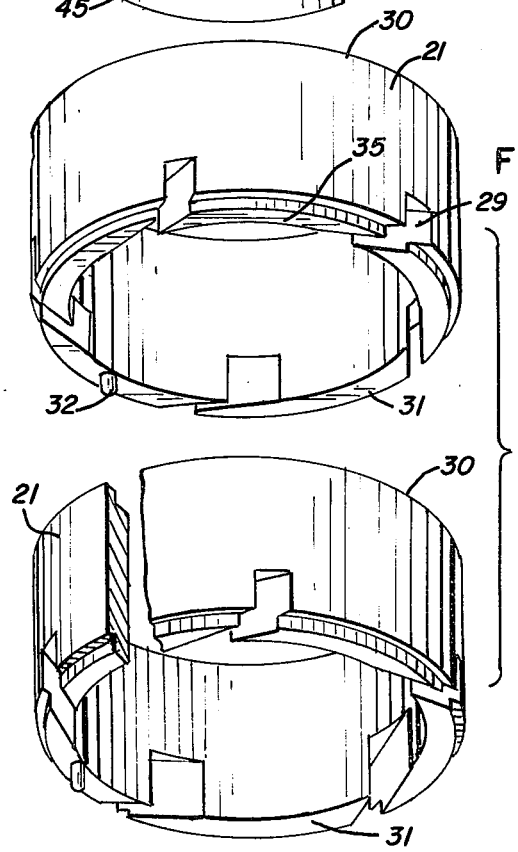

As best seen in FIG. 5*b*, port 29 is defined by a downwardly opening slot extending radially outwardly through the element portion 31. As best seen in FIG. 3, a plurality of slots 29 are provided in the lower surface portion 31 and in the illustrated embodiment, five such slots are provided equiangularly about the axis of element 21. Each slot is further arranged chordally to the axis so as to provide a reaction force on the element 21 from the exiting liquid, tending to rotate the element. In the illustrated embodiment, the slot extends tangentially to the inner surface of element portion 31.

As indicated briefly above, any suitable number of elements 21 may be stacked to provide a desired length of the spray head coordinated with the height of the tank to be washed. As each of the elements is identical, they may be formed at low cost as from molded synthetic resin.

The spray head is rotatably journaled to the supply tube delivery portion 18 by the upper elements 22 illustrated in FIG. 5*a* and lower elements 23 illustrated in FIG. 5*c*. Upper elements 22 include an annular head 36 and a bearing insert 37. The insert includes three radially projecting bosses 38 spaced at 120° angles and recesses 39 are aligned with each of the bosses to receive the nuts 25 of the tie bolt means. Head 36 may be provided with cylindrical grooves 40 for accommodating the tie bolts 24 and recesses 41 for receiving the bosses 38 when the insert 37 is installed in the head 36.

Insert 37 includes a frustoconical lower portion 42 provided with a plurality of channels 43. Head 36 defines a frustoconical inner surface 44. Insert portion 42 is adapted to have a snug fit within surface 44 in the assembled arrangement whereby channels 43 effectively define upwardly directed ports for directing washing liquid upwardly from the upper end assembly 22 against the undersurface of top wall 13.

Head 36 further defines a lower portion 45 adapted to receive the upper portion 30 of the upper element 21. Upper portion 46 of head 36 defines a collar against which the upper surface portion 30 of the subjacent element 21 abuts in the assembled relationship of the spray head.

Lower end assembly 23 includes a closure element 47 having a lowermost collar portion 48 and an upper stem portion 49. Assembly 23 further includes a bearing element 50 having a lower annular flange portion 51 and an upper bearing portion 52. The bearing portion includes vertical grooves 53 adapted to receive a portion of the tie bolts 24, and as shown in FIG. 4, the lower portion of the bearing portion may be provided with a recess 54 adapted to receive the head 55 of the tie bolt.

The stem 49 of closure element 47, as seen in FIG. 4, is adapted to be fitted into the lower end of the supply tube portion 18 to close portion 18 and cause the washing liquid to pass outwardly through openings 27, space 28, and spray ports 29 to provide the desired tank washing streams. Bearing element 50 is adapted to mount coaxially about the lower end of delivery portion 18 in abutment with the collar portion 48 of closure element 47, as seen in FIG. 4. Thus, the spray head is rotatably journaled on the delivery tube portion 18 by means of the bearing 52 and the bearing 37 at the opposite ends of the spray head.

The reaction force of the jet streams is sufficient to readily overcome the low frictional resistance of the bearings and cause a slow rotation of the spray head during the washing operation. As indicated above, in one such tank washer embodying the invention, the spray head rotated at approximately 650 R.P.M. at a liquid supply pressure of approximately 22 p.s.i.g. It was found that the spray head rotation could be effected with a relatively low pressure, such as approximately 4 p.s.i.g.

Each of bearings 52 and 37 may effectively float on the respective mounting elements 47 and 36 and may be lubricated by the washing liquid during the rotational operation for improved life of the washer apparatus.

The spray pattern may be suitably selected by selection of port sizes and distribution. In conventional bulk tank washing operations, it is desirable to provide a relatively heavy washing action on the sidewalls of the tank and a relatively light washing action on the underside of the top wall, or lid, of the tank. Thus, relatively few channels 43 may be provided with each channel having a relatively small cross section, whereas relatively numerous ports 29 may be provided with each port having a relatively large cross section.

To provide improved control of the spray pattern, the supply tube may be longitudinally adjustable in connector 17 so as to permit raising or lowering of the spray head 19, as desired.

Upon completion of the washing operation, the washing liquid may drain out downwardly through a port 56 in the closure element 47, as shown in FIG. 4, to drain the apparatus. Upon draining thereof, the spray head may be removed from the tank by upward removal of the connector 17 and withdrawal of the spray head through the lid opening 57, to be replaced by suitable means, such as a cap, liquid stirring means, etc., as desired.

The foregoing disclosure of specific embodiments is illustrative of the broad inventive concepts comprehended by the invention.

I claim:

1. In a tank washer apparatus having a liquid supply tube provided with a delivery end portion free of internal obstructions for delivering tank washing liquid, annular shoulder means on the distal end of said delivery portion, and mounting means for mounting the supply tube to a tank, the improvement comprising a spray head rotatably carried by said supply tube and having means responsive to the delivery of washing liquid under pressure thereto from said delivery portion to rotate said spray head and provide a plurality of outwardly directed distributed streams of washing liquid moving transversely in a preselected tank washing spray pattern, said spray head including a plurality of internested annular elements in coaxial end-to-end relationship to define a tubular assembly thereof, adjoining pairs of said elements cooperatively defining spray ports for providing said streams of washing liquid, securing means outwardly of said supply tube for securing said elements in said end-to-end relationship to form a rotary spray head assembly, said shoulder means defining a coaxial annular bearing for rotatively supporting said assembly for rotation about the axis of the supply tube delivery portion.

2. The tank washer apparatus of claim 1 wherein said streams are formed by said spray head to have a substantially rectangular cross section on passing outwardly from the spray head.

3. The tank washer apparatus of claim 1 wherein said spray head assembly includes a plurality of identical annular elements stacked in coaxial relationship.

4. The tank washer apparatus of claim 1 wherein said spray head elements define an upper annular surface having a radially outer upwardly projecting shoulder, and a lower annular surface having a radially inner downwardly projecting shoulder adapted to nest within the upwardly directed shoulder of a superjacent annular element.

5. The tank washer apparatus of claim 1 wherein said spray head elements define an upper annular surface having a radially outer upwardly projecting shoulder, and a lower annular surface having a radially inner downwardly projecting shoulder adapted to nest within the upwardly directed shoulder of a superjacent annular element, said ports including a lower portion extending through said downwardly projecting shoulder and an upper portion extending above and outwardly from said lower portion whereby the upwardly projecting shoulder of the subjacent annular element defines a deflector for deflecting angularly upwardly a portion of the liquid passing outwardly through the port.

6. The tank washer apparatus of claim 1 wherein said annular shoulder means comprises a closure plug closing said distal end of the supply tube and having an annular outer collar portion projecting radially outwardly from said supply duct defining said annular bearing.

7. The tank washer apparatus of claim 1 wherein said annular shoulder means comprises a closure plug closing said distal end of the supply tube and having an annular outer collar portion projecting radially outwardly from said supply duct defining said annular bearing, said closure plug having a drain port for draining the apparatus upon termination of liquid delivery thereto, and further providing a downwardly directed stream axially of said delivery portion during delivery of liquid thereto.

8. The tank washer apparatus of claim 1 wherein said supply duct delivery portion is provided with an upper annular bearing journaling an upper end portion of the spray head assembly on the supply duct and provided with a plurality of upwardly directed ports providing a second tank washing liquid spray pattern.

9. The tank washer apparatus of claim 1 wherein said supply duct delivery portion comprises a rectilinear duct having a plurality of radial ports, and said spray head assembly comprises a tubular structure coaxially surrounding said delivery portion and having an internal diameter greater than the outer diameter of said delivery portion to define a liquid transfer annular space therebetween.

10. The tank washer apparatus of claim 1 including upwardly and downwardly directed ports in the spray head assembly for providing additional liquid streams.

* * * * *

UNITED STATES PATENT AND TRADEMARK OFFICE

CERTIFICATE OF CORRECTION

PATENT NO. : 4,030,513

DATED : June 21, 1977

INVENTOR(S) : WRAY V. McKENZIE

It is certified that error appears in the above-identified patent and that said Letters Patent are hereby corrected as shown below:

Column 6, line 20 (Claim 6, line 5), after "supply" cancel "duct" and substitute therefor --tube--;

line 26 (Claim 7, line 5), after "supply" cancel "duct" and substitute therefor --tube--;

lines 33 and 35 (Claim 8, lines 2 and 4), after "supply" cancel "duct" and substitute therefor --tube--;

line 39 (Claim 9, line 2), after "supply" cancel "duct" and substitute therefor --tube--.

Signed and Sealed this

*First* Day of *May 1979*

[SEAL]

*Attest:*

RUTH C. MASON
*Attesting Officer*

DONALD W. BANNER
*Commissioner of Patents and Trademarks*